US005580482A

United States Patent [19]

Chasan et al.

[11] Patent Number: 5,580,482

[45] Date of Patent: Dec. 3, 1996

[54] STABILIZED LUBRICANT COMPOSITIONS

[75] Inventors: David E. Chasan, Teaneck, N.J.; Patricia R. Wilson, White Plains, N.Y.

[73] Assignee: Ciba-Geigy Corporation, Tarrytown, N.Y.

[21] Appl. No.: 372,637

[22] Filed: Jan. 13, 1995

[51] Int. Cl.[6] ..... C10M 141/08; C10M 141/06

[52] U.S. Cl. ..... 508/243; 508/262; 508/279; 508/281

[58] Field of Search ..... 252/47.5, 50, 51.5 R, 252/51.5 A, 56 S

[56] References Cited

U.S. PATENT DOCUMENTS

| | | | |
|---|---|---|---|
| 1,934,100 | 11/1933 | Stiepel | 87/9 |
| 2,114,525 | 4/1938 | Eichwald | 87/9 |
| 2,260,417 | 10/1941 | Whiteley et al. | 252/56 |
| 3,992,307 | 11/1976 | Hotten | 252/46.7 |
| 4,637,885 | 1/1987 | Kuwamoto et al. | 252/32.5 |
| 4,701,273 | 10/1987 | Brady et al. | 252/32.5 |
| 4,734,209 | 3/1988 | Phillips et al. | 252/47 |
| 4,783,274 | 11/1988 | Jokinen et al. | 252/32.7 |
| 5,254,272 | 10/1993 | Walters et al. | 252/51.5 R |
| 5,358,652 | 10/1994 | Macpherson | 252/51.5 R |
| 5,413,725 | 5/1995 | Lal et al. | 252/56 S |

FOREIGN PATENT DOCUMENTS

| | | |
|---|---|---|
| 2105132 | 3/1994 | Canada . |
| 586194 | 3/1994 | European Pat. Off. . |
| 900756 | 7/1962 | United Kingdom . |

OTHER PUBLICATIONS

Lubrication Science 5–3, Ren et al., Apr. 1993 (5) 205–212.

Han et al, STLE Tribology Transactions vol. 36 (1993), 2, 283–289.

Derw. Abst. 100:9802 (date unknown).

*Primary Examiner*—Jerry D. Johnson

*Attorney, Agent, or Firm*—Michele A. Kovaleski

[57] ABSTRACT

The instant invention relates to a lubricant composition stabilized against the deleterious effects of heat and oxygen. The composition comprises a triglyceride oil or an oil which is an ester wherein unsaturation is present in either the alcohol moiety or the acid moiety and an effective stabilizing amount of either an N,N-disubstituted aminomethyl-1,2,4-triazole or an N,N-disubstituted aminomethylbenzotriazole; a higher alkyl substituted amide of dodecylene succinic acid; a phenolic antioxidant; and an aromatic amine antioxidant. Further additives can be added to these lubricant formulations.

23 Claims, No Drawings

STABILIZED LUBRICANT COMPOSITIONS

The instant invention relates to a lubricant composition stabilized against the deleterious effects of heat and oxygen said composition comprising a triglyceride oil or an oil which is an ester wherein unsaturation is present in either the alcohol moiety or the acid moiety and an effective stabilizing amount of either an N,N-disubstituted aminomethyl-1,2,4-triazole or an N,N-disubstituted aminomethylbenzotriazole and a higher alkyl substituted amide of dodecylene succinic acid.

The instant compositions find utility as hydraulic fluids, two-stroke engine oils, chain saw oils, mold release oils, open gear lubricants, grease, fuels, lubricants for farming, mining, forestry and railroad equipment, and the like.

BACKGROUND OF THE INVENTION

It is well known that lubricants are readily susceptible to decomposition and thus require the addition of various stabilizers and other additives in order to improve performance characteristics. Degradation of the lubricant is primarily due to the action of heat, mechanical stress (especially induced by shear forces) and chemical reagents (especially atmospheric oxygen). Deterioration of the lubricant results in an increase in total acidity, formation of gums, discoloration, loss of physical properties such as viscosity, loss of potency, polymerization, rancidity and/or odor.

This problem is particularly acute for triglyceride oils which tend to deteriorate easily due to their high degree of unsaturation. The oxidation proceeds via a mechanism which is initiated by the formation of a free radical and occurs rather easily in triglyceride oils due to the high content of active methylene groups adjacent to the double bonds. The overall effect is a high susceptability of the oil to oxidation, which is further complicated by contact of the oil with metals, such as iron and copper, present in the equipment or material to be lubricated. Metals act as catalysts in the oxidation process and accelerate degradation of the oil.

Accordingly, stabilizers are added to the lubricant in order to retard or eliminate degradation, thereby extending the life of said lubricant. For example, British Patent No. 900,756 relates to the stabilization of organic substrates subject to oxidative deterioration by the addition of metal deactivators. The stabilized organic substrates mentioned therein include lubricants, fats and oils.

U.S. Pat. No. 4,783,2725 is directed toward delaying the oxidative degradation of triglyceride oils by using selected free radical trapping antioxidants in moderate amounts. Further, EP 0,586,194 A1 relates to a stabilized triglyceride composition containing at least one alkyl phenol and optionally a metal deactivator selected from the group consisting of specified benzotriazoles, phosphatides, carbamates, citric acid derivatives, coupled phosphorus-containing amides and methyl acrylate derivatives. An aromatic amine may also be incorporated therein.

It has now been found that incorporating a certain combination of a metal deactivator for non-ferrous metals and a ferrous metal corrosion inhibitor in a triglyceride oil in accordance with the instant invention leads to surprisingly outstanding performance characteristics.

OBJECTS OF THE INVENTION

One object of the instant invention is to provide lubricant compositions which are stabilized by incorporating therein an effective stabilizing amount of either an N,N-disubstituted aminomethyl-1,2,4-triazole or an N,N-disubstituted aminomethylbenzotriazole; a higher alkyl substituted amide of dodecylene succinic acid; a phenolic antioxidant; and an aromatic amine antioxidant.

Another object of the invention is to provide a process for stabilizing a lubricant by incorporating therein an effective stabilizing amount of either an N,N-disubstituted aminomethyl-1,2,4-triazole or an N,N-disubstituted aminomethylbenzotriazole; a higher alkyl substituted amide of dodecylene succinic acid; a phenolic antioxidant; and an aromatic amine antioxidant.

Still other objects will become apparent from the discussion set forth hereinbelow.

DETAILED DISCLOSURE

The instant invention pertains to a lubricant composition stabilized against the deleterious effects of heat and oxygen, which composition comprises (a)(i) a natural triglyceride oil which is an ester of a straight-chain $C_{10}$ to $C_{22}$ fatty acid and glycerol, which triglyceride has an iodine number of at least about 9 and not more than about 133 illustrating its degree of unsaturation; or (ii) a natural or synthetic oil which is an ester wherein unsaturation is present in either the alcohol moiety or the acid moiety or both;

(b)(i) an effective stabilizing amount of a metal deactivator of the formula

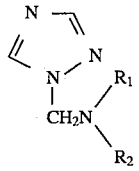

(I)

wherein $R_1$ and $R_2$ are, independently of one another, hydrogen, $C_1$–$C_{20}$alkyl, $C_3$–$C_{20}$alkenyl, $C_5$–$C_{12}$cycloalkyl, $C_7$–$C_{13}$aralkyl, $C_6$–$C_{10}$aryl, hydroxyl, or $R_1$ and $R_2$, together with the nitrogen atom to which they are attached, form a 5-, 6- or 7-membered heterocyclic residue, or $R_1$ and $R_2$ is each a residue of formula $$R_{16}X[(\text{alkylene})O]_n(\text{alkylene})— \quad (II)$$

in which X is O, S or N; $R_{16}$ is hydrogen or $C_1$–$C_{20}$alkyl; alkylene is a $C_1$–$C_{12}$alkylene residue; and n is 0 or an integer from 1 to 6; or $R_1$ has its previous significance and $R_2$ is a residue of formula

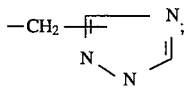

(III)

or $R_2$ is a residue of formula (III) as defined above and $R_1$ is a residue of formula $$—[\text{alkylene}]_n—N(R_{17})—A—[N(R_{17})_2]_m \quad (IV)$$

in which m is 0 or 1 and, when m is 0, A is a residue of formula (III) and, when m is 1, A is alkylene or $C_6$–$C_{10}$arylene, and alkylene and n have their previous significance and $R_{17}$ is a residue of formula III, as defined above; or (ii) a metal deactivator of the formula

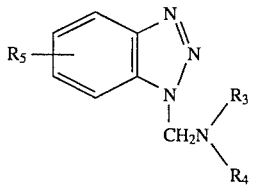

(V)

wherein $R_3$ and $R_4$, each independently of the other, are as $R_1$ and $R_2$ defined hereinabove; and $R_5$ is hydrogen or $C_1$–$C_{12}$alkyl; and (c) an effective stabilizing amount of a higher alkyl substituted amide of dodecylene succinic acid.

The triglyceride oil is a glycerol ester of a fatty acid, or mixtures thereof, which ester can be defined by means of the following formula

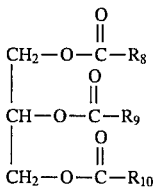

wherein $R_8$, $R_9$ and $R_{10}$ can be the same or different and are selected from the group consisting of saturated and unsaturated straight-chained alkyl, alkenyl and alkadienyl chains of ordinarily 9 to 22 carbon atoms.

The triglyceride oils of the instant invention are generally naturally occurring and are, for example, fish, animal or vegetable triglyceride oil, or mixtures thereof. Preferably, the triglyceride oil is a vegetable triglyceride oil such as palm nut oil, palm oil, olive oil, rapeseed oil, canola oil, linseed oil, ground nut oil, soybean oil, cottonseed oil, sunflower seed oil, pumpkin seed oil, coconut oil, corn oil, castor oil, walnut oil and mixtures thereof. Most preferably, the triglyceride oil is sunflower seed oil, rapeseed oil or canola oil.

The iodine numbers of the triglyceride oils for use in the instant invention may be determined by methods commonly known and used in the industry, such as the ASTM D1959 taken from the standards set by the American Society for Testing and Materials. The following results represent typical iodine numbers as measured by said ASTM D1959:

| Triglyceride Oil | Iodine No. (typical) | Iodine No. (range) |
|---|---|---|
| Babassu | 16 | 15–19 |
| Butter Fat | 30 | 25–35 |
| Cocoa Butter | 40 | 35–43 |
| Coconut | 9 | 8–12 |
| Corn | 125 | 120–128 |
| Cotton Seed | 110 | 105–116 |
| Lard | 73 | 65–80 |
| Olive | 85 | 80–88 |
| Palm | 50 | 45–55 |
| Palm Kernel | 17 | 16–20 |
| Peanut | 98 | 90–110 |
| Rapeseed | 101 | 95–108 |

-continued

| Triglyceride Oil | Iodine No. (typical) | Iodine No. (range) |
|---|---|---|
| Rice Bran | 110 | 100–120 |
| Safflower | 132 | 127–140 |
| High Oleic Safflower | 93 | 90–100 |
| Sesame | 110 | 100–120 |
| Sorghum | 115 | 105–120 |
| Soybean | 130 | 125–140 |
| Sunflower | 130 | 120–140 |
| Tallow Beef | 40 | 35–50 |
| Tallow Mutton | 40 | 35–46 |

The values set forth above are from typical analyses, normalized and rounded off, as taken from the Technical Bulletin of PVO Internationals Inc. These values can vary as is known in the art.

The lubricant according to the instant invention may also be a natural or synthetic oil which is an ester wherein unsaturation is present in either the alcohol moiety or the acid moiety. The ester may be formed by a transesterification reaction of suitable monobasic and/or dibasic organic acids with primary, secondary or tertiary alcohols, which ester is represented by the following formula

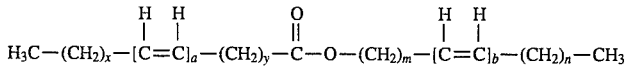

wherein a is 0 or 1, b is 0 or 1, but a and b cannot be 0 at the same time, and x, y, m and n are, each independently of the other, 1–20. An example of such a naturally occurring ester is jojoba oil and such a synthetic ester is lauryl oleate.

Alternatively, the above ester may be formed by the reaction of unsaturated acids with polyhydric alcohols such as neopentyl glycol, trimethylolylethane, trimethylolpropane or pentaerythritol. Examples of such a reaction product is pentaerythritol monooleate, dioleate, trioleate, and the like.

The metal deactivator in accordance with the instant invention is an N,N-disubstituted aminomethyl-1,2,4-triazole, an N,N-disubstituted aminomethyl-benzotriazole or mixtures thereof, with the former group of compounds being the more preferred. The N,N-disubstituted aminomethyl-1,2,4-triazole can be prepared by a known method, namely be reacting a 1,2,4-triazole with formaldehyde and an amine, $HNR_1R_2$, as described in U.S. Pat. No. 4,734,209. The N,N-disubstituted aminomethyl-benzotriazole can be similarly obtained by reacting a benzotriazole with formaldehyde and an amine $HNR_3R_4$, as is known in the art and described for example in U.S. Pat. No. 4,701,273. Preferably, $R_5$ is hydrogen or methyl.

Preferably, the metal deactivator is 1-[bis(2-ethylhexyl)aminomethyl]-1,2,4-triazole or 1-[bis(2-ethylhexyl)aminomethyl]-4-methylbenzotriazole, with the former compound being the most preferred. The compounds are available from Ciba-Geigy Corporation under the names of IRGAMET® 30 and IRGAMET® 39, respectively.

The rust inhibitor for use in accordance with the instant invention is a higher alkyl substituted amide of dodecylene succinic acid, preferably HITEC® 536, a material which is commercially available from Ethyl Petroleum Additives, Inc. It is believed that HITEC® 536 is of the following structure and can be made according to the following reaction scheme, as can similar higher alkyl substituted amides of dodecenyl succinic acid.

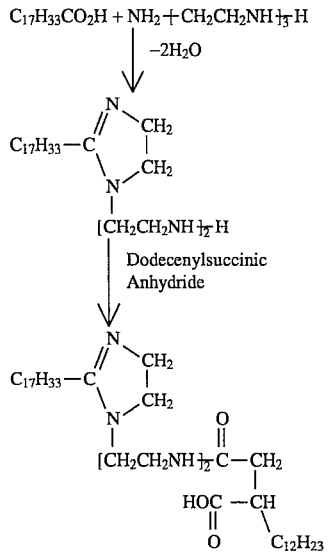

It has now been surprisingly found that use of the instantly specified combination of metal deactivator and rust inhibitor in lubricants, especially a triglyceride oil or the instant oily esters, leads to unexpectedly superior performance characteristics, particularly in the presence of a phenolic antioxidant and an aromatic amine antioxidant. Most significantly, oxidation of the lubricant is retarded to a much greater degree in accordance with the instant invention than with other combinations of additives. Further, any lubricant, not limited to a triglyceride oil or the instant oily esters, may be stabilized in accordance with the instant invention.

Accordingly, the instant metal deactivator and corrosion inhibitor are each employed in from about 0.01 to about 3.0% by weight of the stabilized composition, although this will vary with the particular substrate and application. An advantageous range is from 0.03 to about 1.0%, and especially from 0.04 to about 0.4%. Generally, component (a) is employed in the range of from about 78 to about 99.8%, preferably from about 85 to about 99.8%, and most preferably of from 94 to about 99.8%, by weight of the stabilized composition.

The instant invention further relates to a process for enhancing the performance properties of oils, in particular by retarding degradation and extending the life thereof. Thus, (i) a natural triglyceride oil which is an ester of a straight-chain $C_{10}$ to $C_{22}$ fatty acid and glycerol, which triglyceride has an iodine number of at least about 9 and not more than about 133; or (ii) a natural or synthetic oil which is an ester wherein unsaturation is present in either the alcohol moiety or the acid moiety against the deleterious effects of heat and oxygen, which process comprises the steps of adding to said oil (a)(i) an effective stabilizing amount of a metal deactivator of the formula (I) defined hereinabove or of the formula (V) as well as an effective stabilizing amount of a higher alkyl substituted amide of dodecylene succinic acid.

The compounds of instant components (b) and (c) of the instant compositions can be blended with the triglyceride oil in a manner known per se. The compounds are, for example, readily soluble in oils. It is also possible to prepare a masterbatch, which can be diluted in accordance with consumption to suitable concentrations with the appropriate oil. In such case, much higher concentrations are possible.

The instant triglyceride oil compositions may optionally also contain various other additives, or mixtures thereof, in order to improve the basic properties thereof. These further additives comprise antioxidants, other metal deactivators, other corrosion inhibitors, viscosity improvers, dispersants, detergents, extreme-pressure and antiwear additives and pour-point depressants.

Illustrative examples of such further additives are, but not limited to, the following:

Examples of phenolic antioxidants

1. Alkylated Monophenols 2,6-Di-tert-butyl-4-methylphenol, 2,6-di-tert-butylphenol, 2-tert-butyl-4,6-dimethyl-phenol, 2,6-di-tert-butyl-4-ethyl-phenol, 2,6-di-tert-butyl-4-n-butylphenol, 2,6-di-tert-butyl-4-i-butylphenol, 2,6-di-cyclopentyl-4-methylphenol, 2-(β-methylcyclohexyl)-4,6-dimethylphenol, 2,6-di-octadecyl-4-methylphenol, 2,4,6-tri-cyclohexylphenol, 2,6-di-tert-butyl-4-methoxymethylphenol, o-tert-butylphenol.

2. Alkylated Hydroquinones 2,6-Di-tert-butyl-4-methoxyphenol, 2,5-di-tert-butyl-hydroquinone, 2,5-di-tert-amyl-hydroquinone, 2,6-diphenyl-4-octa-decyloxyphenol.

3. Hydroxylated Thiodiphenylethers 2,2'-Thio-bis-(6-tert-butyl-4-methylphenol), 2,2'-thio-bis-(4-octyl-phenyl), 4,4'-thio-bis-(6-tert-butyl-3-methylphenol), 4,4'-thio-bis-(6-tert-butyl-2-methylphenol).

4. Alkylidene-Bisphenols 2,2'-Methylene-bis-(6-tert-butyl-4-methylphenol), 2,2'-methylene-bis-(6-tert-butyl-4-ethylphenol), 2,2'-methylene-bis-(4-methyl-6-(α-methyl-cyclohexyl)-phenol), 2,2'-methylene-bis-(4-methyl-6-cyclohexylphenol), 2,2'-methylene-bis-(6-nonyl-4-methylphenol), 2,2'-methylene-bis-(4,6-di-tert-butylphenol), 2,2'-ethylidene-bis-(4,6-di-tert-butylphenol), 2,2'-ethylidene-bis-(6-tert-butyl-4- or-5-isobutylphenol), 2,2'-methylene-bis-(6-(α-methylbenzyl-4-nonylphenol), 2,2'-methylene-bis-(6-(α,α-di-methylbenzyl)-4-nonylphenol), 4,4'-methylene-bis-(2,6-di-tert-butyl-phenol), 4,4'-methylene-bis-(6-tert-butyl-2-methylphenol), 1,1-bis-(5-tert-butyl-4-hydroxy- 2-methyl-phenol)-butane, 2,6-di-(3-tert-butyl-5-methyl-2-hydroxy-benzyl)-4-methyl-phenol, 1,1,3-tris-(5-tert-butyl-4-hydroxy-2-methylphenyl)-3-n-dodecyl)-mercaptobutane, ethyleneglycol-bis-[3,3-bis-(3'-tert-butyl-4'-hydroxyphenyl)-butyrate], bis-(3-tert-butyl-4-hydroxy-5-methylphenyl)-dicyclopentadiene, bis-[2-(3'-tert-butyl-2'-hydroxy-5'-methyl-benzyl)-6-tert-butyl-4-methyl-phenyl]-terephthalate.

5. Benzyl Compounds 1,3,5-Tri-(3,5-di-tert-butyl-4-hydroxybenzyl)-2,4,6-trimethyl-benzene, bis(3,5-di-tert-butyl-4-hydroxybenzyl)-sulfide, 3,5-di-tert-butyl-4-hydroxybenzyl-mercaptoacetic acid-isooctylester, bis-(4-tert-butyl-3-hydroxy-2,6-dimethyl-benzyl)dithiolterephthalate, 1,3,5-tris-(3,5-di-tert-butyl-4-hydroxybenzyl)-isocyanurate, 1,3,5-tris-(4-tert-butyl-3-hydroxy-2,6-dimethylbenzyl)-isocyanurate, 3,5-di-tert-butyl-4-hydroxybenzyl-phosphonic acid-dioctadecylester, 3,5-di-tert-butyl-4-hydroxybenzyl-phosphonic acid-monoethylester, calcium-salt.

6. Acylaminophenols

4-Hydroxy-lauric acid anilide, 4-hydroxy-stearic acid anilide, 2,4-bis-octylmercapto-6-(3,5-di-tert-butyl-4-hydroxyanilino)-s-triazine, N-(3,5-di-tert-butyl-4-hydroxyphenyl)-carbamic acid octyl ester.

7. Esters of β-(3,5-Di-tert-butyl-4-hydroxyphenyl)-propionic acid with mono- or polyhydric alcohols, for example with methanol, isooctyl alcohol, 2-ethylhexanol, diethylene glycol, octadecanol, triethylene glycol, 1,6-hexanediol, pentaerythritol, neopentyl glycol, tris-hydroxyethyl isocyanurate, thiodiethylene glycol, bis-hydroxyethyl-oxalic acid diamide.

8. Esters of β-(5-tert-butyl-4-hydroxy-3-methylphenyl)-propionic acid with mono- or polyhydric alcohols, for example with methanol, isooctyl alcohol, 2-ethylhexanol, diethylene glycol, octadecanol, triethylene glycol, 1,6-hexanediol, pentaerythritol, neopentyl glycol, tris-hydroxyethyl isocyanurate,thiodiethylene glycol, di-hydroxyethyl-oxalic acid diamide.

9. Amides of β-(3,5-Di-tert-butyl-4-hydroxyphenyl)-propionic acid for example N,N'-Bis-(3,5-di-tert-butyl-4-hydroxyphenylpropionyl)-hexamethylene-diamine, N,N'-bis-(3,5-di-tert-butyl-4-hydroxy-phenylpropionyl)-trimethylene-diamine, N,N'-bis(3,5-di-tert-butyl-4-hydroxyphenylpropionyl)-hydrazine.

Examples of amine antioxidants:

N,N'-Di-isopropyl-p-phenylenediamine, N,N'-di-sec.-butyl-p-phenylenediamine, N,N'-bis(1,4-dimethyl-pentyl)-p-phenylenediamine, N,N'-bis(1-ethyl-3-methyl-pentyl)-p-phenylenediamine, N,N'-bis(1-methyl-heptyl)-p-phenylenediamine, N,N'-dicyclohexyl-p-phenylenediamine, N,N'-diphenyl-p-phenylenediamine, N,N'-di-(naphthyl-2)-p-phenylemediamine, N-isoporpyl-N'-phenyl-p-phenylenediamine, N-(1,3-dimethylbutyl)-N'-phenyl-p-phenylenediamine, N-(1-methyl-heptyl)-N'-phenyl-p-phenylenediamine, N-cyclohexyl-N'-phenyl-p-phenylenediamine, 4-(p-toluene-sulfonamido)-diphenylamine, N,N'-dimethyl-N,N'-di-sec-butyl-p-phenylenediamine, di-phenylamine, N-allyldiphenylamine, 4-isopropoxy-diphenylamine, N-phenyl-1-naphthylamine, N-phenyl-2-naphthylamine, octylated diphenylamine, e.g. p,p'-di-tert-octyldiphenylamine, 4-n-butylaminophenol, 4-butyrylamino-phenol, 4-nonanoylamino-phenol, 4-dodecanoylamino-phenol, 4-octadecanoyl-amino-phenol, di-(4-methoxy-phenyl)-amine, 2,6-di-tert-butyl-4-dimethyl-amino-methyl-phenol, 2,4'-diamino-diphenylmethane, 4,4'-diamino-diphenylmethane, N,N,N',N'-tetramethyl-4,4'-diamino-diphenylmethane, 1,2-di-(phenylamino)-ethane, ethane, 1,2-di-[2-methyl-phenyl)-amino]-ethane, 1,3-di-(phenylamino)-propane, (o-tolyl)-biguanide, di-[4-1'3'-dimethyl-butyl)-phenyl]amine, tert-octylated N-phenyl-1-naphthylamine, mixture of mono- and dialkylated tert-butyl-/tert-octyldiphenylamines, 2,3-dihydro-3,3-dimethyl-4H-1,4-benzothiazine, phenothiazine, N-allylphenothiazine, tert-octylated phenothiazine, 3,7-di-tert-octylphenothiazine.

Examples for other antioxidants:

Aliphatic or aromatic phosphites, esters of thiodipropionic acid or of thiodiacetic acid, or salts of dithiocarbamic or dithiophosphoric acid.

Examples of metal passivators, for example for copper, are:

Triazoles, benzotriazoles and derivatives thereof, tolutriazole and derivatives thereof, e.g. di(2-ethylhexyl)-aminomethyltolutriazole, 2-mercaptobenzothiazole, 5,5'-methylene-bis-benzotriazole, 4,5,6,7-tetrahydrobenzo-triazole, salicyclidene-propylene-diamine and salicyclamino-guanidine and salts thereof.

Examples of rust inhibitors are:

a) Organic acids, their esters, metal salts and anhydrides, e.g. N-oleoyl-sarcosine, sorbitan-mono-oleate, lead-naphthenate, alkenyl-succinic acids and -anhydrides, e.g. dodecenyl-succinic acid anhydride, succinic acid partial esters and amines, 4-nonyl-phenoxy-acetic acid.

b) Nitrogen-containing compounds, e.g. I. Primary, secondary or tertiary aliphatic or cycloaliphatic amines and amine-salts of organic and inorganic acids, e.g. oil-soluble alkyl-ammonium carboxylates II. Heterocyclic compounds, e.g. substituted imidazolines and oxazolines.

c) Phosphorus-containing compounds, e.g. amine salts of phosphonic acid or phosphoric acid partial esters, zinc dialkyldithio phosphates.

d) Sulfur-containing compounds, e.g. barium-dinonyl-naphthalene-n-sulfonates, calcium petroleum sulfonates.

e) Derivatives of gamma-alkoxypropylamines described in Japanese Patent Publication No. 15783/1973; and f) Salts having the formula $Y—NH_3—R_{10}CO_2—$ in which Y is a group $R_{11}X_1CH_2CH(OH)CH_2$ in which $R_{10}$ and $R_{11}$, independently, are e.g. alkyl and $X_1$ is O, $CO_2$, NH, N(alkyl), N(alkenyl) or S, these salts being prepared by mixing an amine $Y—NH_2$ with an acid $R_{10}CO_2H$, as disclosed in DE-OS 3437 876 (German Offenlegungsschrift).

g) Compounds having the formula $$R_{12}—X_2—CH_2—CH(OH)—CH_2NR_{13}R_{14}$$

in which $X_2$ is —O—, —S—, $—SO_2—C(O)—O—$ or —N(Rd) in which $R_{12}$ is H or $C_1$–$C_{12}$alkyl, $R_{13}$ is unsubstituted $C_1$–$C_4$alkyl or $C_2$–$C_5$alkyl substituted by one to three hydroxyl groups, $R_{14}$ is hydrogen, unsubstituted $C_1$–$C_4$alkyl or $C_2$–$C_5$alkyl substituted by one to three hydroxyl groups provided that at least one of $R_{13}$ and $R_{14}$ is hydroxy-substituted, and $R_{12}$ is $C_2$–$C_{20}$alkyl $—CH_2—CH(OH)—CH_2NR_{13}R_{14}$ or $R_{12}$ is $C_2$–$C_{18}$ alkenyl, $C_2$–$C_3$alkynyl or $C_5$–$C_{12}$cycloalkyl provided that, when $X_2$ is —O— or —C(O)—O—, $R_{12}$ is branched $C_4$–$C_{20}$alkyl. These compounds are described in British Patent Specification 2172284A.

h) Compounds having the formula:

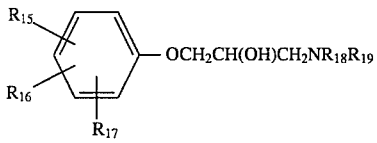

in which $R_{15}$, $R_{16}$, $R_{17}$ are, independently, hydrogen, $C_1$–$C_{15}$alkyl, $C_5$–$C_2$cycloakyl $C_6$–$C_{15}$aryl or $C_7$–$C_{12}$aralkyl and $R_{18}$ and $R_{19}$, independently, are hydrogen, 2-hydroxyethyl or 2-hydroxypropyl, provided that $R_{18}$ and $R_{19}$ are not simultaneously hydrogen and, when $R_{18}$ and $R_{19}$ are each $—CH_2CH_2OH$, $R_{15}$ and $R_{16}$ are not simultaneously hydrogen and $R_{17}$ is not pentyl. These compounds are described in EP Patent specification 0,252,007.

Examples of viscosity-index improvers are:

Polyacrylates, polymethacrylates, vinylpyrrolidone/methacrylate-copolymers, polyvinylpyrrolidones, polybutanes, olefin-copolymers, styrene/-acrylate-copolymers, polyethers.

Examples of pour-point depressants are:

Polymethacrylates, alkylated naphthalene derivatives.

Examples of dispersants/detergents are:

Polybutenylsuccinic acid-amides or-imides, polybutenylphosphonic acid derivatives, basic magnesium-, calcium-, and bariumsulfonates and -phenolales.

Examples of anti-wear additives and extreme pressure additives are:

Sulphur- and/or phosphorus- and/or halogen-containing compounds e.g. sulphurised vegetable oils, zinc dialkyldithiophosphates, tritolylphosphate, chlorinated paraffins, alkyl- and aryldi- and trisulphides, triphenylphosphorothionates and amine phosphates.

In a particularly preferred embodiment of the instant invention, the composition in accordance with the instant invention further comprises a hindered phenolic antioxidant and an aromatic amine antioxidant.

The phenolic antioxidant of particular interest is selected from the group consisting of 2,6-di-tert-butyl phenol (known as Irganox® 140 from Ciba-Geigy Corporation), BHT, 2,2'-methylene-bis-(4,6-di-tert-butylphenol), 1,6-hexamethylene-bis(3,5-di-tert-butyl-4-hydroxyhydrocinnamate)(known as Irganox® L109 from Ciba-Geigy Corporation), (((3,5-bis(1,1-dimethylethyl)-4-hydroxyphenyl)methyl)thio) acetic acid, $C_{10}$–$C_{14}$isoalkyl esters (known as Irganox® L118 from Ciba-Geigy Corporation), 3,5-di-tert-butyl-4-hydroxyhydrocinnamic acid, $C_7$–$C_9$ alkyl esters (known as Irganox® L135 from Ciba-Geigy Corporation), tetrakis-(3-(3,5-di-tert-butyl-4-hydroxyphenyl)-propionyloxymethyl)methane (known as Irganox® 1010 from Ciba-Geigy Corporation), thiodiethylene bis(3,5-di-tert-butyl-4-hydroxyhydrocinnamate (known as Irganox® 1035 from Ciba-Geigy Corporation), octadecyl 3,5-di-tert-butyl-4-hydroxyhydrocinnamate (known as lrganox® 1076 from Ciba-Geigy Corporation) and 2,5-di-tert-butyl-hydroquinone. These materials are well known in the art and are commercially available. Of particular interest are 2,6-di-tert-butyl phenol, tetrakis-(3-(3,5-di-tert-butyl-4-hydroxyphenyl)-propionyloxymethyl)methane, 1,6-hexamethylene-bis(3,5-di-tert-butyl-4-hydroxyhydrocinnamate) and thiodiethylene bis(3,5-di-tert-butyl-4-hydroxyhydrocinnamate.

The aromatic amine stabilizer of particular interest is a compound of the formula

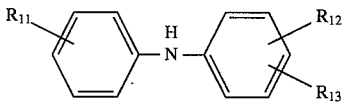

wherein $R_{11}$, $R_{12}$ and $R_{13}$ are, each independently of the other, hydrogen or $C_1$–$C_{24}$alkyl and are preferably hydrogen or $C_4$–$C_{18}$alkyl. Also of particular interest is a compound of the formula

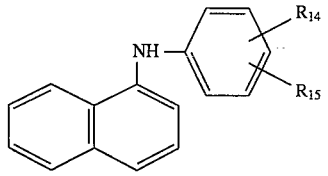

wherein $R_{14}$ and $R_{15}$ are, each independently of the other, hydrogen or $C_1$–$C_{24}$alkyl, and preferably $R_{14}$ is hydrogen and $R_{15}$ is $C_8$–$C_{15}$alkyl. Of most interest is where the aromatic amine stabilizer comprises a mixture of alkylated diphenylamines such that $R_{11}$, $R_{12}$ and $R_{13}$ are independently hydrogen, $C_4H_9$ and $C_8H_{17}$. These aromatic amine stabilizers are well known in the art, with some being commercially available, and are described, for example in U.S. Pat. No. 4,824,601.

The phenolic antioxidant and aromatic amine stabilizer are each employed in from about 0.05 to about 8.0% by weight of the stabilized composition, although this will vary with the particular substrate and application. An advantageous range is from 0.08 to about 8.0%, and especially from 0.01 to about 5.0%.

The following examples are presented for the purpose of illustration only and are not to be construed to limit the nature or scope of the instant invention in any manner whatsoever. Unless indicated otherwise, parts and percentages are by weight.

EXAMPLES 1–10

TABLE 1

| | 1 | 2 | 3 | 4 | 5 | 6 | 7 | 8 | 9 | 10 |
|---|---|---|---|---|---|---|---|---|---|---|
| Component A | | | | | | | | | | |
| Vegetable Oil[1] | 100 | 99.75 | 99.75 | 99.75 | 99.75 | 99.75 | 99.75 | 99.75 | 99.75 | 99.75 |
| Component B | | | | | | | | | | |
| Substituted Tolutriazole[2] | — | 0.04 | 0.04 | 0.04 | 0.04 | 0.04 | 0.04 | 0.04 | 0.04 | 0.04 |
| Component C | | | | | | | | | | |
| Alkenyl succinic acid half esters[3] | — | 0.04 | — | — | 0.04 | — | — | 0.04 | — | — |
| Ic12 Amine phosphate[4] | — | — | 0.04 | — | — | 0.04 | — | — | 0.04 | — |
| Fatty Amide of dodecenyl succinic acid[5] | — | — | — | 0.04 | — | — | 0.04 | — | — | 0.04 |
| Component D | | | | | | | | | | |
| 2,6-DTBP | — | 0.13 | 0.13 | 0.13 | — | — | — | — | — | — |
| Thiodiethylene-bis(3,5-di-tert-butyl-4-hydroxyhydro-cinnamate[6] | — | — | — | — | 0.13 | 0.13 | 0.13 | — | — | — |
| 1,6-hexamethylene bis(3,5-di-tert-butyl- | — | — | — | — | — | — | — | 0.13 | 0.13 | 0.13 |

TABLE 1-continued

| | 1 | 2 | 3 | 4 | 5 | 6 | 7 | 8 | 9 | 10 |
|---|---|---|---|---|---|---|---|---|---|---|
| 4-hydroxyhydro-cinnamate[7] | | | | | | | | | | |
| Component E | | | | | | | | | | |
| Alkylated diphenylamine[8] | — | 0.04 | 0.04 | 0.04 | 0.04 | 0.04 | 0.04 | 0.04 | 0.04 | 0.04 |
| Results | | | | | | | | | | |
| Hours To 2.0 Acid Number | 11 | 76 | 44 | 111 | 62 | 77 | 98 | 76 | 13 | 97 |
| Hours to 200% viscosity increase | 24 | 103 | 64 | 136 | 86 | 96 | 106 | 88 | 51 | 117 |

The notes in Table 1 have the following meanings:
[1]Sunflower Oil (Trade Name Sunyl 80; produced by SVO)
[2]Irgamet ®39 (produced by Ciba-Geigy Corporation)
[3]Irgacor ®12 (produced by Ciba-Geigy Corporation)
[4]Irgalube ®349 (produced by Ciba-Geigy Corporation)
[5]Hitec ®536 (produced by Ethyl)
[6]Irganox ®1035 (produced by Ciba-Geigy Corporation)
[7]Irganox ®L109 (produced by Ciba-Geigy Corporation)
[8]Irganox ®L57 (produced by Ciba-Geigy Corporation)

Table 1 shows the compositions and test results of Samples 1–10. The compositions are prepared by dissolving the indicated additives in the vegetable oil by stirring at 60° C. for one hour.

Samples 1–10 are evaluated for oxidative stability, which evaluation is carried out by a modified version of the standard IP 306 (Oxidative Stability of Straight Mineral Oil Test). The modifications are made in order to render the test more suitable for vegetable oil and include the following: test temperature is 95° C., and the catalyst is a bimetallic coil consisting of 15 inches each of a copper and an iron wire coiled together.

The acid number and viscosity increase are monitored periodically by ASTM D-664 acid number titration and a cone-on-plate viscometer. The time to an acid number increase of 2.0 and a viscosity increase of 200% are measures of the relative oxidative lifetimes of the Samples. A longer lifetime indicates better resistance to oxidation.

Samples 1–10 show that the vegetable oil samples stabilized in accordance with the instant invention (i.e., the specific combination of metal deactivator and corrosion inhibitor of Samples 4, 7 and 10) exhibit significant improvements in acid and viscosity deterioration relative to the samples containing other combinations of additives. While certain antioxidant combinations give better results than others, the best results are consistently achieved by the samples containing the instant metal deactivator and the instant corrosion inhibitor.

EXAMPLES 11–19

TABLE 2

| | 11 | 12 | 13 | 14 | 15 | 16 | 17 | 18 | 19 |
|---|---|---|---|---|---|---|---|---|---|
| Component A | | | | | | | | | |
| Vegetable Oil[1] | 99.75 | 99.75 | 99.75 | 99.75 | 99.75 | 99.75 | 99.75 | 99.75 | 99.75 |
| Component B | | | | | | | | | |
| Substituted 1,2,4-triazole[2] | 0.04 | 0.04 | 0.04 | 0.04 | 0.04 | 0.04 | 0.04 | 0.04 | 0.04 |
| Component C | | | | | | | | | |
| Alkenyl succinic acid, half ester[3] | 0.04 | — | — | 0.04 | — | — | 0.04 | — | — |
| amine phosphate[4] | — | 0.04 | — | — | 0.04 | — | — | 0.04 | — |
| Fatty amide of dodecenyl succinic acid[5] | — | — | 0.04 | — | — | 0.04 | — | — | 0.04 |
| Component D | | | | | | | | | |
| 2,6-DTBP | 0.13 | 0.13 | 0.13 | — | — | — | — | — | — |
| Thiodiethylene-bis(3,5-di-tert-butyl-4-hydroxyhydrocinnamate[6] | — | — | — | 0.13 | 0.13 | 0.13 | — | — | — |
| 1,6-hexamethylene bis(3,5-di-tert-butyl-4-hydroxyhydrocinnamate[7] | — | — | — | — | — | — | 0.13 | 0.13 | 0.13 |

TABLE 2-continued

| | 11 | 12 | 13 | 14 | 15 | 16 | 17 | 18 | 19 |
|---|---|---|---|---|---|---|---|---|---|
| Component E | | | | | | | | | |
| Alkylated diphenylamine[8] | 0.04 | 0.04 | 0.04 | 0.04 | 0.04 | 0.04 | 0.04 | 0.04 | 0.04 |
| Results | | | | | | | | | |
| Hours To 2.0 Acid Number | 104 | 122 | 168 | 103 | 100 | 149 | 109 | 103 | 171 |
| Hours to 200% viscosity increase | 127 | 130 | 175 | 122 | 118 | 173 | 125 | 137 | 193 |

The notes in Table 2 have the following meanings:
Notes 1 and 3–7 are as defined in Table 1.
Note 2: Irgamet ®30 (produced by Ciba-Geigy Corporation)

Examples 11–19 are prepared and evaluated in the same manner as Examples 1–10.

As above, Samples 11–19 show that the vegetable oil samples stabilized in accordance with the instant invention (i.e., the specific combination of metal deactivator and corrosion inhibitor of Samples 13, 16 and 19) exhibit significant improvements in acid and viscosity deterioration relative to the samples containing other combinations of additives. While certain antioxidant combinations give better results than other combinations, the best results are consistently achieved by the samples containing the instant metal deactivator and the instant corrosion inhibitor.

EXAMPLES 20–31

TABLE 3

| Components | 20 | 21 | 22 | 23 | 24 | 25 | 26 | 27 | 28 | 29 | 30 | 31 |
|---|---|---|---|---|---|---|---|---|---|---|---|---|
| Canola Oil | 100 | 99.68 | 99.68 | 98.96 | 99.68 | 98.00 | — | — | — | — | — | — |
| Sunflower Oil | — | — | — | — | — | — | 100 | 99.68 | 99.68 | 98.96 | 98.68 | 98.00 |
| Substituted 1,2,4-triazole[2] | — | 0.32 | — | — | — | 0.32 | — | 0.32 | — | — | — | 0.32 |
| Fatty amide of dodecenyl succinic acid[5] | — | — | 0.32 | — | — | 0.32 | — | — | 0.32 | — | — | 0.32 |
| 2,6-DTBP | — | — | — | 1.04 | — | 1.04 | — | — | — | 1.04 | — | 1.04 |
| Alkylated diphenylamine[8] | — | — | — | — | 0.32 | 0.32 | — | — | — | — | 0.32 | 0.32 |
| RBOT*(minutes) | 15 | 13 | 12 | 20 | 15 | 192 | 18 | 16 | 21 | 141 | 27 | 269 |

Notes 2,5 and 8 are as defined as in Table 1.
*RBOT = Rotary Bomb Oxidation Test Table 3 shows the compositions and test results of Samples 20–31. The compositions are prepared in the same manner as those of Examples 1–10.

The RBOT (Rotary Bomb Oxidation Test) in minutes is measured in accordance with ASTM D-2272. A longer oxidative lifetime indicates better resistance to oxidation.

Samples 20–31 show that both canola oil and sunflower oil stabilized in accordance with the instant invention (i.e., the specific combination of metal deactivator and corrosion inhibitor of Samples 25 and 31 ) exhibit a significant improvement in resistance to oxidation relative to the Samples containing only a single additive.

What is claimed is:

1. A lubricant composition stabilized against the deleterious effects of heat and oxygen, which composition comprises (a)(i) a natural triglyceride oil which is an ester of a straight-chain $C_{10}$ to $C_{22}$ fatty acid and glycerol, which triglyceride has an iodine number of at least about 9 and not more than about 133 illustrating its degree of unsaturation; or (ii) a natural or synthetic oil which is an ester wherein unsaturation is present in either the alcohol moiety or the acid moiety or both;

(b)(i) an effective stabilizing amount of a metal deactivator of the formula

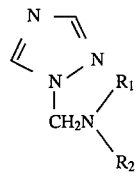

(I)

wherein $R_1$ and $R_2$ are, independently of one another, hydrogen, $C_1$–$C_{20}$alkyl, $C_3$–$C_{20}$alkenyl, $C_5$–$C_{12}$cycloalkyl, $C_7$–$C_{13}$aralkyl, $C_6$–$C_{10}$aryl, hydroxyl, or $R_1$ and $R_2$, together with the nitrogen atom to which they are attached, form a 5-, 6- or 7-membered heterocyclic residue, or $R_1$ and $R_2$ is each a residue of formula $$R_{16}X[(\text{alkylene})O]_n(\text{alkylene})— \quad (II)$$

in which X is O, S or N; $R_{16}$ is hydrogen or $C_1$–$C_{20}$alkyl; alkylene is a $C_1$–$C_{12}$alkylene residue; and n is O or an integer from 1 to 6; or $R_1$ has its previous significance and $R_2$ is a residue of formula

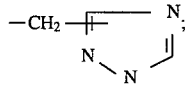

(III)

or $R_2$ is a residue of formula (III) as defined above and $R_1$ is a residue of formula $$—[\text{alkylene}]_n—N(R_{17})—A—[N(R_{17})_2]_m \quad (IV)$$

in which m is 0 or 1 and, when m is 0, A is a residue of formula (III) and, when m is 1, A is alkylene or $C_6$–$C_{10}$arylene, and alkylene and n have their previous significance and $R_{17}$ is a residue of formula III, as defined above; or (ii) a metal deactivator of the formula

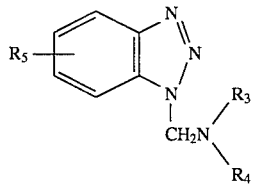

(V)

wherein $R_3$ and $R_4$, each independently of the other, are as $R_1$ and $R_2$ defined hereinabove; and $R_5$ is hydrogen or $C_1$–$C_{12}$alkyl;

(c) an effective stabilizing amount of a higher alkyl substituted amide of dodecylene succinic acid;

(d) an effective stabilizing amount of a phenolic antioxidant; and (e) an effective stabilizing amount of an aromatic amine antioxidant.

2. A composition according to claim 1, wherein component (b) and component (c) are each, independently of the other, are present in the amount of from about 0.03 to about 1.0%, relative to the weight of the stabilized composition.

3. A composition according to claim 2, wherein component (b) and component (c) are each, independently of the other, are present in the amount of from about 0.04 to about 0.4%, relative to the weight of the stabilized composition.

4. A composition according to claim 1, wherein component (a)is a vegetable triglyceride oil.

5. A composition according to claim 4, wherein component (a) consists of palm nut oil, palm oil, olive oil, rapeseed oil, canola oil, linseed oil, ground nut oil, soybean oil, cottonseed oil, sunflower seed oil, pumpkin seed oil, coconut oil, corn oil, castor oil, walnut oil or mixtures thereof.

6. A composition according to claim 5, wherein component (a) consists of rapeseed oil, canola oil, sunflower seed oil or mixtures thereof.

7. A composition according to claim 1, wherein component (a) is a fish oil.

8. A composition according to claim 1, wherein component (a) is an ester of at least one straight chain fatty acid and glycerol, said fatty acid containing from about 8 to about 22 carbon atoms.

9. A composition according to claim 8, wherein said fatty acid is oleic acid.

10. A composition according to claim 1, wherein component (b)(ii) is 1-[bis(2-ethylhexyl)aminomethyl]-4-methylbenzotriazole.

11. A composition according to claim 1, wherein component (b)(i) is 1-[bis(2-ethylhexyl)aminomethyl]-1,2,4-triazole.

12. A composition according to claim 1, wherein component (c) is substituted (2-higher alkyl-2-imidazolin-1-yl)-3-iminopentamethylene dodecylene succinamide (HITEC® 536).

13. A composition according to claim 1, wherein component (b)(i) is 1-[bis(2-ethylhexyl)aminomethyl]-1,2,4-triazole and component (c) is substituted (2-higher alkyl-2-imidazolin-1-yl)-3-iminopentamethylene dodecylene succinamide (HITEC® 536).

14. A composition according to claim 1, wherein component (d) is 2,6-di-tert-butyl phenol; BHT; 2,2'-methylene-bis-(4,6-di-tert-butylphenol); 1,6-hexamethylene-bis(3,5-di-tert-butyl-4-hydroxyhydrocinnamate); (((3,5-bis(1,1-dimethylethyl)-4-hydroxyphenyl)methyl)thio) acetic acid, $C_{10}$–$C_{14}$isoalkyl esters; 3,5-di-tert-butyl-4-hydoxyhydrocinnamic acid, $C_7$–$C_9$ alkyl esters; tetrakis-(3-(3,5-di-tert-butyl-4-hydroxyphenyl)-propionyloxymethyl)methane; thiodiethylene bis(3,5-di-tert-butyl-4-hydroxyhydrocinnamate; octadecyl 3,5-di-tert-butyl-4-hydroxyhydrocinnamate; or 2,5-di-tert-butyl-hydroquinone.

15. A composition according to claim 14, wherein component (d) is 2,6-di-tert-butyl phenol; tetrakis-[(3-(3,5-di-tert-butyl-4-hydroxyphenyl)-propionyloxymethyl]methane; 1,6-hexamethylene-bis(3,5-di-tert-butyl-4-hydroxyhydrocinnamate ); or thiodiethylene bis(3,5-di-tert-butyl-4-hydroxyhydrocinnamate).

16. A composition according to claim 1, wherein component (e) is tert-octyl-N-phenyl-1-naphthylamine or a diphenylamine, or mixture thereof, of formula VI

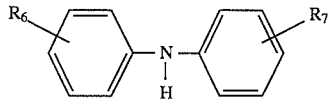

(VI)

wherein $R_6$ and $R_7$ are, each independently of the other, hydrogen or $C_1$–$C_{20}$alkyl.

17. A composition according to claim 16, wherein $R_6$ and $R_7$ are, each independently of the other, hydrogen, butyl or octyl.

18. A composition according to claim 1, which further comprises an additive, or mixtures thereof, selected from a further antioxidant, a further metal deactivator, a further corrosion inhibitor, a viscosity improver, a dispersant, a detergent, an extreme-pressure and antiwear additive and a pour-point depressant.

19. A composition according to claim 1, wherein component (b)(i) is 1-[bis(2-ethylhexyl)-aminomethyl]-1,2,4-triazole, component (c) is substituted (2-higher alkyl-2-imidazolin- 1-yl)-3-iminopentamethylene dodecylene succinamide (HITEC®536); component (d) is 1,6-hexamethylene-bis(3,5-di-tert-butyl-4-hydroxyhydrocinnamate; and component (e) is a diphenylamine, or mixtures thereof, of formula

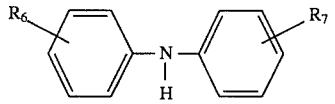

(VI)

wherein $R_6$ and $R_7$ are, each independently of the other, hydrogen, butyl or octyl.

20. A composition according to claim 19, wherein the additives (b), (c), (d) and (e) are added to component (a) in a weight ratio relative to one another of approximately 1:1:3.25:1, respectively.

21. A composition according to claim 1, wherein components (d) and (e) are each, independently of the other, present in the amount of from about 0.05 to about 8.0%, relative to the weight of the stabilized composition.

22. A process for stabilizing (i) a natural triglyceride oil which is an ester of a straight-chain $C_{10}$ to $C_{22}$ fatty acid and glycerol, which triglyceride has an iodine number of at least about 9 and not more than about 133; or (ii) a natural or synthetic oil which is an ester wherein unsaturation is present in either the alcohol moiety or the acid moiety against the deleterious effects of heat and oxygen, which process comprises the steps of adding to said oil (a)(i) an effective stabilizing amount of a metal deactivator of the formula

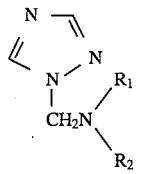

(I)

wherein $R_1$ and $R_2$ are, independently of one another, hydrogen, $C_1$–$C_{20}$alkyl, $C_3$–$C_{20}$alkenyl, $C_5$–$C_{12}$cycloalkyl, $C_7$–$C_{13}$aralkyl, $C_6$–$C_{10}$aryl, hydroxyl, or $R_1$ and $R_2$, together with the nitrogen atom to which they are attached, form a 5-, 6- or 7-membered heterocyclic residue, or $R_1$ and $R_2$ is each a residue of formula $$R_{16}X[(\text{alkylene})O]_n(\text{alkylene})— \quad (II)$$

in which X is O, S or N; R16 is hydrogen or $C_1$–$C_{20}$alkyl; alkylene is a $C_1$–$C_{12}$alkylene residue; and n is 0 or an integer from 1 to 6; or $R_1$ has its previous significance and $R_2$ is a residue of formula

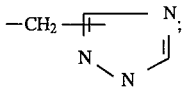

(III)

or $R_2$ is a residue of formula (III) as defined above and $R_1$ is a residue of formula $$—[\text{alkylene}]_n—N(R_{17})—A—[N(R_{17})_2]_m \quad (IV)$$

in which m is 0 or 1 and, when m is 0, A is a residue of formula (III) and, when m is 1, A is alkylene or $C_6$–$C_{10}$arylene, and alkylene and n have their previous significance and $R_{17}$ is a residue of formula III, as defined above; or (ii) a metal deactivator of the formula

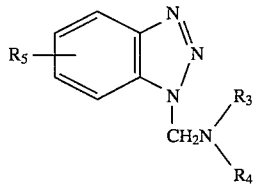

(V)

wherein $R_3$ and $R_4$, each independently of the other, are as $R_1$ and $R_2$ defined hereinabove; and $R_5$ is hydrogen or $C_1$–$C_{12}$alkyl; and (b) an effective stabilizing amount of a higher alkyl substituted amide of dodecylene succinic acid;

(c) an effective stabilizing amount of a hindered phenolic antioxidant; and (d) an effective stabilizing amount of an aromatic amine stabilizer.

23. A process according to claim 22, further comprising the steps of adding an effective stabilizing amount of a further additive, or mixtures thereof, selected from a further antioxidant, a further metal deactivator, a further corrosion inhibitor, a viscosity improver, a dispersant, a detergent, an extreme-pressure and antiwear additive and a pour-point depressant.

* * * * *